US005601130A

United States Patent [19]

Werner et al.

[11] Patent Number: 5,601,130

[45] Date of Patent: Feb. 11, 1997

[54] SHUTTER BLADE, ASSEMBLY AND METHOD

[75] Inventors: Robert I. Werner, Northbrook; Gennady Z. Plavnik, Buffalo Grove, both of Ill.; Eric C. Horne; Fred L. Murrin, both of Greenville, Pa.

[73] Assignee: Werner Co., Greenville, Pa.

[21] Appl. No.: 245,709

[22] Filed: May 18, 1994

[51] Int. Cl.[6] ..... E06B 3/48

[52] U.S. Cl. ..... 160/183; 160/235; 160/199; 160/118

[58] Field of Search ..... 160/183, 118, 160/199, 206, 235, 236, 201, 133; 16/387, 224

[56] References Cited

U.S. PATENT DOCUMENTS

| | | | |
|---|---|---|---|
| 3,156,210 | 11/1964 | Lyon | 160/235 X |
| 3,359,594 | 12/1967 | Pastoor | 160/235 X |
| 4,386,645 | 6/1983 | Dever et al. | 160/183 |
| 5,097,883 | 3/1992 | Robinson et al. | 160/183 |
| 5,220,951 | 6/1993 | Dagenais | 160/235 X |

FOREIGN PATENT DOCUMENTS

| | | | |
|---|---|---|---|
| 1561474 | 2/1968 | France | 160/183 |

*Primary Examiner*—Blair Johnson
*Attorney, Agent, or Firm*—Ansel M. Schwartz

[57] ABSTRACT

A shutter blade comprising a center portion having a receiving and a hooking end. The receiving end has a first opening which connects with a hooking end of another shutter blade. The first opening surface fits into and conforms with the first opening and there is continuous contact therebetween when the hooking end of the other shutter blade and the first opening surface are in a folded state. Alternatively, whether the first opening surface is of opposite shape as the hooking end surface or not, the receiving end can have a second opening separated from the first opening by a common wall. The shutter blade contacts a track mechanism through the second opening. Such shutter blades can be used in a shutter blade assembly in which a plurality of shutter blades are foldably connected in series and movably connected to the track mechanism.

12 Claims, 9 Drawing Sheets

FIG. 8
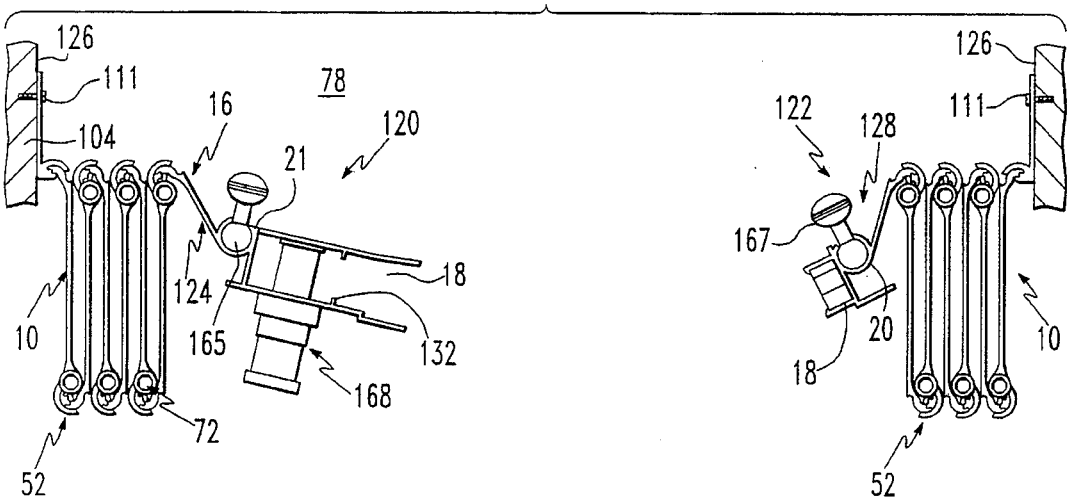
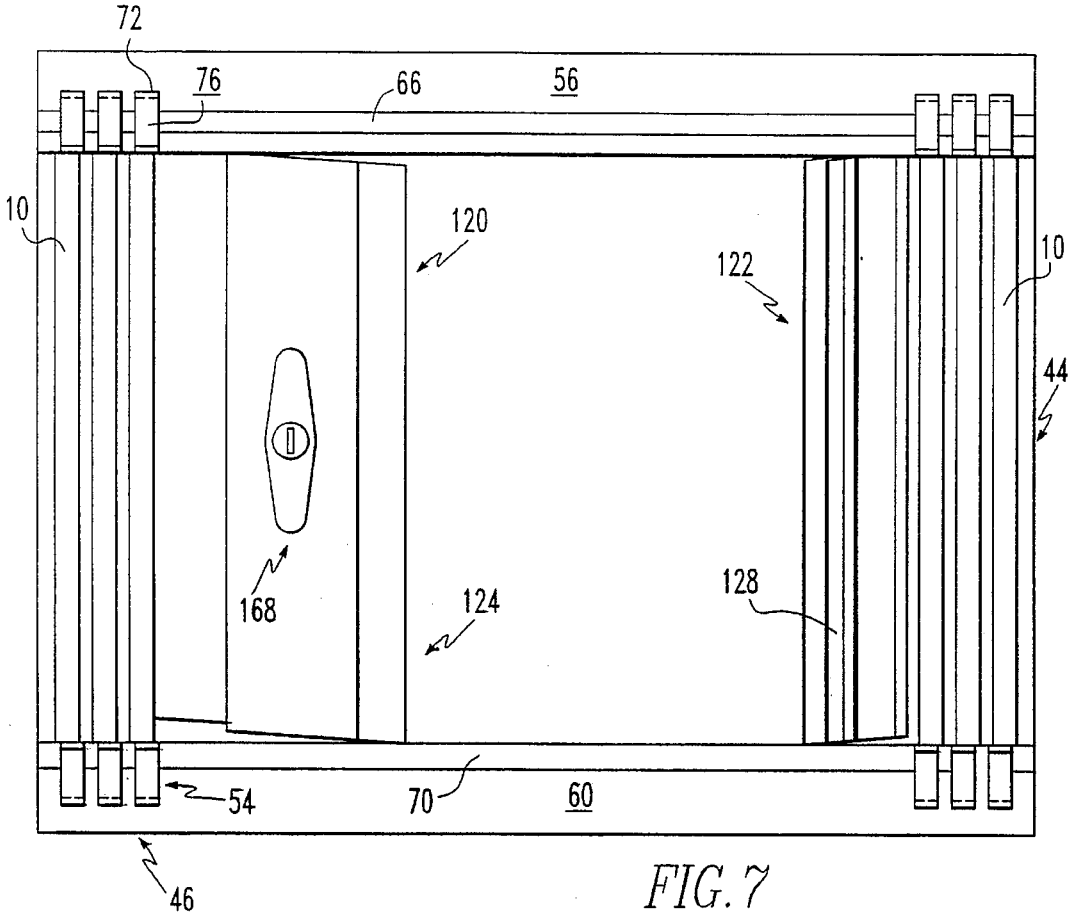
FIG. 7

SHUTTER BLADE, ASSEMBLY AND METHOD

FIELD OF THE INVENTION

The present invention relates to shutter blades. More specifically, the present invention relates to a shutter blade that connects with another shutter blade to form a hinge.

BACKGROUND OF THE INVENTION

In coastal areas, wide ranges of wind speeds are experienced. At the upper range of these wind speeds, such as those wind speeds associated with hurricanes or typhoons, great destruction can result not only from the wind itself, but the objects that are hurled about by the wind. One technique that has arisen to protect against the wind and the flying objects that are caused by the wind is to place shutter blades over a desired area such as a window or door. The shutter blades act as a barrier against the wind and the flying objects, preventing them from contacting and damaging the underlying window or door. Shutter blades offer the advantage of being able to be fixed into place, but yet being movable so they can be set aside to expose the door or window they are to protect until needed. Certain locations such as southern Florida have gone as far as to enact exacting building codes in an effort to regulate the design characteristics of storm shutter assemblies. See Sections 2315 and 2314.5 of the South Florida Building Code and Dade County Protocols PA 201-94, 202-94 and 203-94, all of which are incorporated by reference herein.

Quite often, during high wind situations when flying objects strike the shutter blades, it is not the blades themselves which snap, crack, deform or break. Rather, it is the hinge that is formed by two shutter blades connected together which is broken or degraded when an object strikes it. If the object happens to be stopped from penetrating through the shutter blade barrier after it damages or breaks the hinge, then possibly the next time an object strikes the damaged area, the object might break through the shutter blade barrier and thus the building envelope and crash into the underlying structure being protected by the shutter blades. Due to the dynamic nature of wind, if the underlying door or window is compromised, then the wind can enter the structure causing further damage to the structure's interior to say nothing of what rain water carried by the wind into the structure's interior can do. Consequently, it is apparent that a strong hinge is a necessity for an effective shutter blade assembly. Heretofore, hinges of shutter blade assemblies have not proven as strong as needed pursuant to their weight.

Similarly, shutter blades connected in series to form a screen are also used to protect store fronts or residences. The screen placed in front of doors or windows of the shop serves to prevent vandalism or breaking and entry of the premises. The present invention provides a hinge that is stronger than prior art hinges for a given weight and thus provides a shutter blade screen that is stronger than prior art shutter blade screens.

Furthermore, when the screen is folded and not being used, the folded shutter blade screen is desired to be as unobtrusive as possible. The present invention provides a shutter blade, which when connected in series to form a shutter blade screen, allows the screen to be more compact than prior art screens that pass code requirements in a folded state.

SUMMARY OF THE INVENTION

The present invention pertains to a shutter blade. The shutter blade comprises a center portion having a receiving end and a hooking end. The receiving end has a first opening and a second opening adjacent to but separate from the first opening. The first opening is connected with a hooking end of another shutter blade. The shutter blade contacts a track mechanism through the second opening.

The present invention also pertains to a shutter blade. The shutter blade comprises a center portion having a receiving end and a hooking end. The receiving end has a first opening defined by a first opening surface. The first opening connects with a hooking end of another shutter blade to form a hinge. The first opening surface is of opposite shape as the hooking end surface so the hooking end surface fits into and conforms with the first opening surface and there is continuous contact therebetween when the hooking end of the other shutter blade and the first opening surface are in a closed state.

The present invention also pertains to a shutter blade. The shutter blade comprises a center portion having a receiving end and a hooking end. The receiving end has a first opening and a second opening. The first opening connects with a hooking end of another shutter blade. The shutter blade contacts a track mechanism through the second opening. The receiving end has a curved stem which extends from a wall, such as common wall, that together with the curved stem defines the first opening. The curved stem has a variable thickness, with the thickness being greatest where the stem extends from the wall.

The present invention also pertains to a shutter blade assembly. The shutter blade assembly comprises a track mechanism. The shutter blade assembly also comprises a plurality of shutter blades foldably connected in series and movably connected to the track mechanism. Each shutter blade is connected to another shutter blade at a first location. Each shutter blade contacts the track mechanism through a second location adjacent to but apart from the first location.

The present invention also pertains to a shutter blade assembly. The shutter blade assembly comprises a track mechanism. The shutter blade assembly also comprises a shutter blade screen comprising a plurality of shutter blades foldably connected in series and movably connected to the track mechanism. Each shutter blade is connected to the track mechanism and each shutter blade comprises a center portion having a receiving end and a hooking end. The receiving end has a first opening defined by a first opening surface. The first opening connects with a hooking end of another shutter blade. The first opening surface is of opposite shape as the hooking end surface so the hooking end surface fits into and conforms with the first opening surface and there is continuous contact therebetween when the hooking end of the other shutter blade and the first opening surface are in a closed state.

The present invention also pertains to a shutter blade assembly. The shutter blade assembly comprises a track mechanism. The shutter blade assembly comprises a shutter blade screen comprised of a plurality of shutter blades foldably connected in series and movably connected to the track mechanism. The screen has a folded state and a closed state. The screen has a stacking ratio of up to approximately 13% and is in compliance with South Florida Building Codes Section 2309, 2314.5 and 2315 with revisions to include ASCE 7-88 criteria and large missile impact requirements and Dade County Protocols PA 201-94, 202-94 and 203-94.

The present invention pertains to a shutter blade assembly. The shutter blade assembly comprises a track mechanism. Additionally, the shutter blade assembly comprises a shutter blade screen comprised of a plurality of shutter blades foldably connected in series and movably connected to the track mechanism. The screen is in compliance with South Florida Building Codes Section 2309, 2314.5 and 2315 with revisions to include ASCE 7-88 criteria and large missile impact requirements, and Dade County Protocols PA 201-94, 202-94 and 203-94.

The present invention also pertains to a method for protecting an area. The method comprises the steps of placing a track mechanism about the area. Then there is the step of connecting a plurality of shutter blades attached together in series to the track mechanism. Then there is the step of directing force on a hinge connecting at least the one shutter blade to an adjacent shutter blade in series with the one shutter blade through it in a compressive fashion so the one shutter blade does not disconnect from the adjacent shutter blade. Next there is the step of transferring force from the one shutter blade to the track mechanism by a linkage contacting the track mechanism and the one shutter blade. Preferably, the linkage is disposed at a location separate from the hinge.

The present invention also pertains to a method for constructing a shutter blade screen. The method comprises the steps of fitting a hooking end of a first shutter blade into a first opening of a receiving end of a second shutter blade. Then there is the step of inserting a first bolt into a second opening of the receiving end preferably disposed at a top of the second shutter blade, although the first bolt could just as well be inserted into a second opening of the receiving end 14 disposed at the bottom of the second shutter blade (they are equivalent). The second opening is adjacent but separate from the first opening. The present invention also pertains to a method for constructing a shutter blade assembly. The method comprises the steps of fitting a hooking end of a first shutter blade into a first opening of a receiving end of a second shutter blade so there is continuous contact between the surface of the hooking end and the first opening surface when the first and second shutter blades are in a folded state. Then there is the step of connecting the first and second shutter blades to a track mechanism.

BRIEF DESCRIPTION OF THE DRAWINGS

In the accompanying drawings, the preferred embodiment of the invention and preferred methods of practicing the invention are illustrated in which:

FIG. 7 is a schematic representation of a front view of a shutter blade assembly in a folded state.

FIG. 8 is a schematic representation of an overhead view of a shutter blade assembly in a folded state.

DESCRIPTION OF THE PREFERRED EMBODIMENT

Figure 1A:
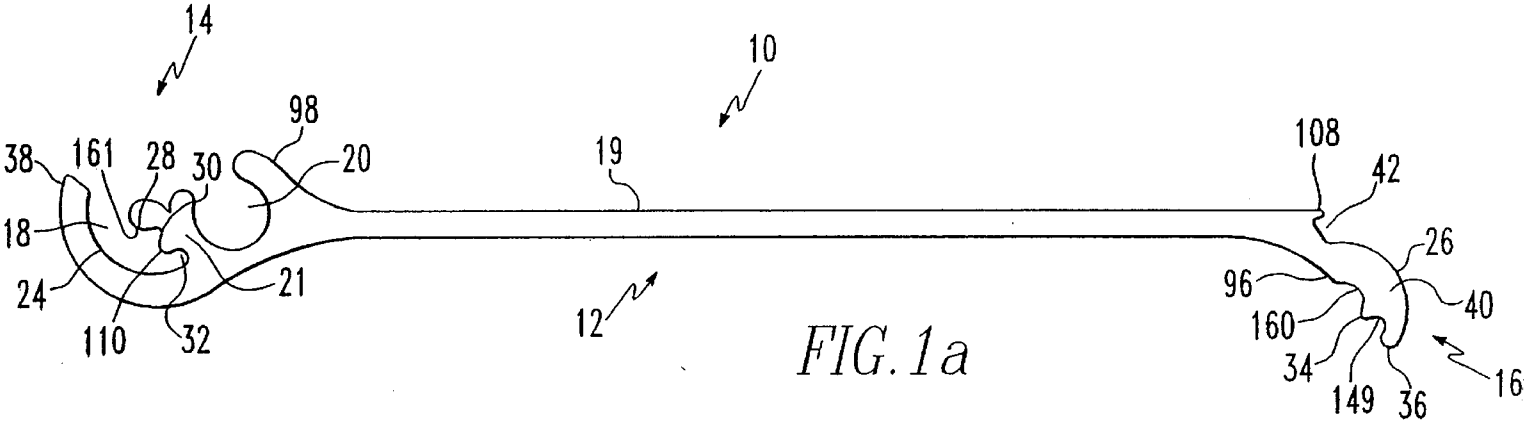
FIG. 1*a* is a schematic representation of a shutter blade of the invention.

Referring now to the drawings wherein like reference numerals refer to similar or identical parts throughout the several views, and more specifically to FIG. 1*a* thereof, there is shown a shutter blade 10. The shutter blade 10 is preferably made out of aluminum, but can be made out of metal, plastic, composite, etc. The shutter blade 10 comprises a center portion 12 having a receiving end 14 and a hooking end 16. Preferably, the center portion 12 is elongate and essentially straight and flat.

Figure 2:
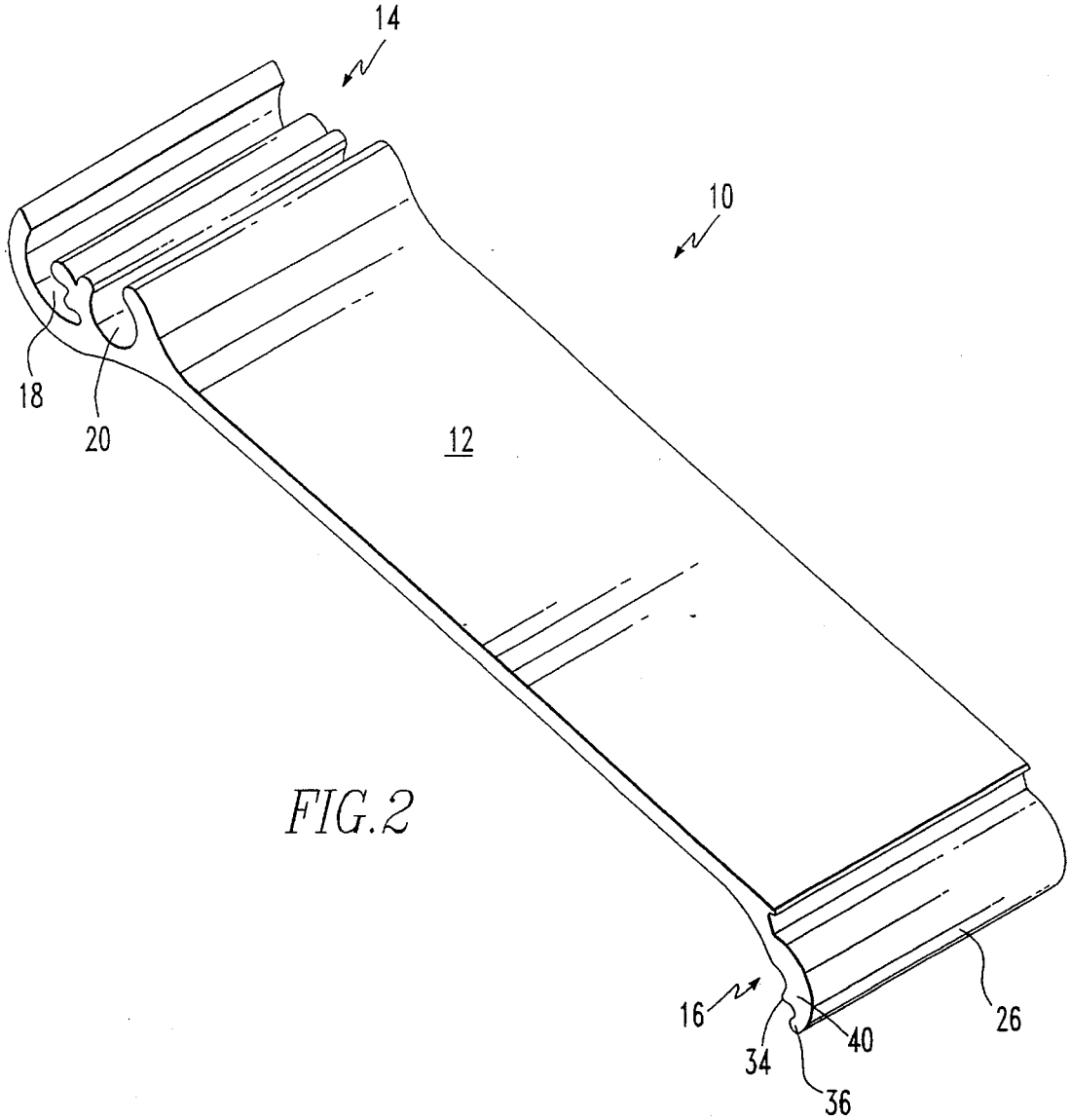
FIG. 2 is a perspective schematic representation of a shutter blade.
Figure 3:
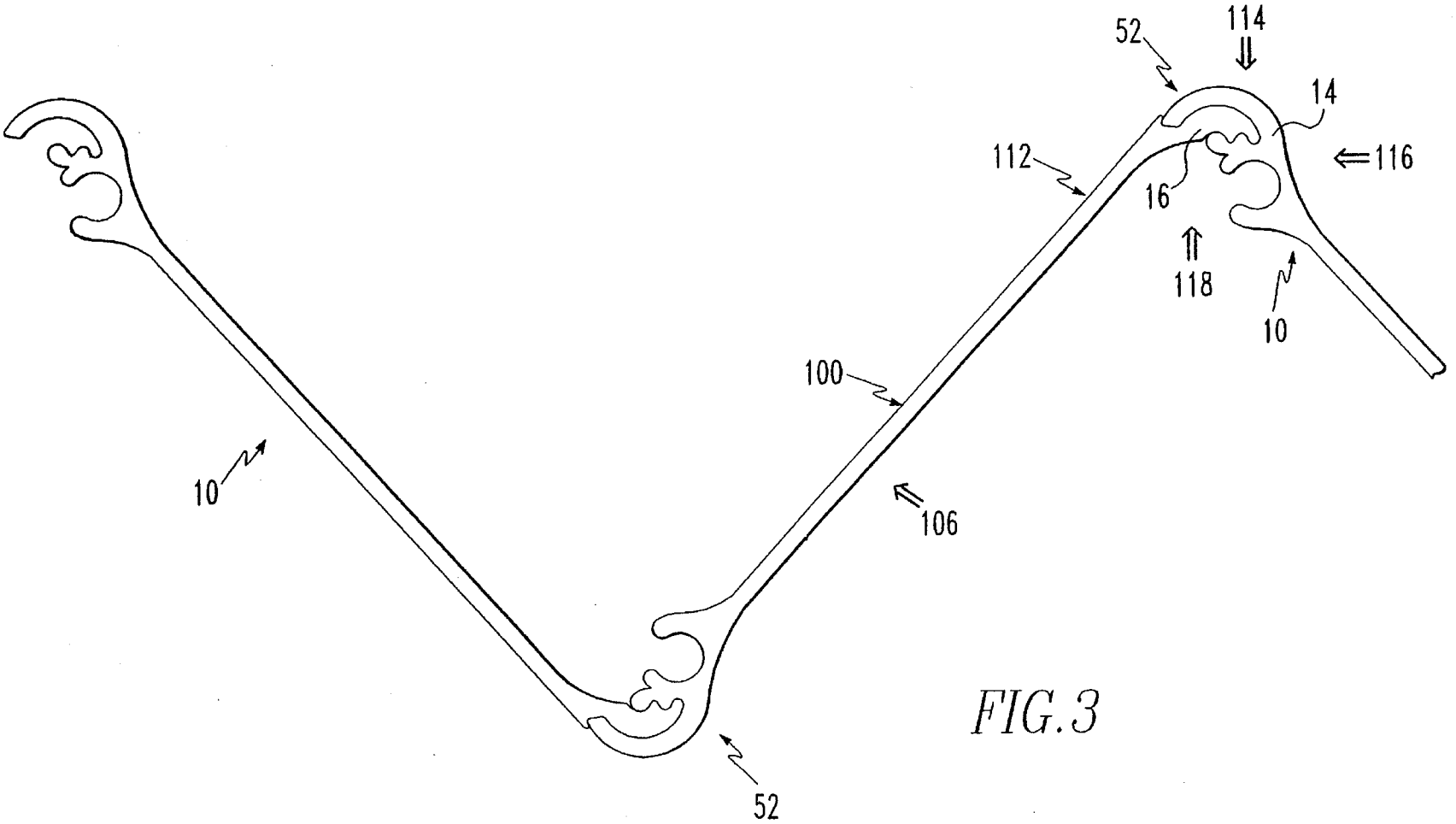
FIG. 3 is a schematic representation of several shutter blades connected together in series.
Figure 4:
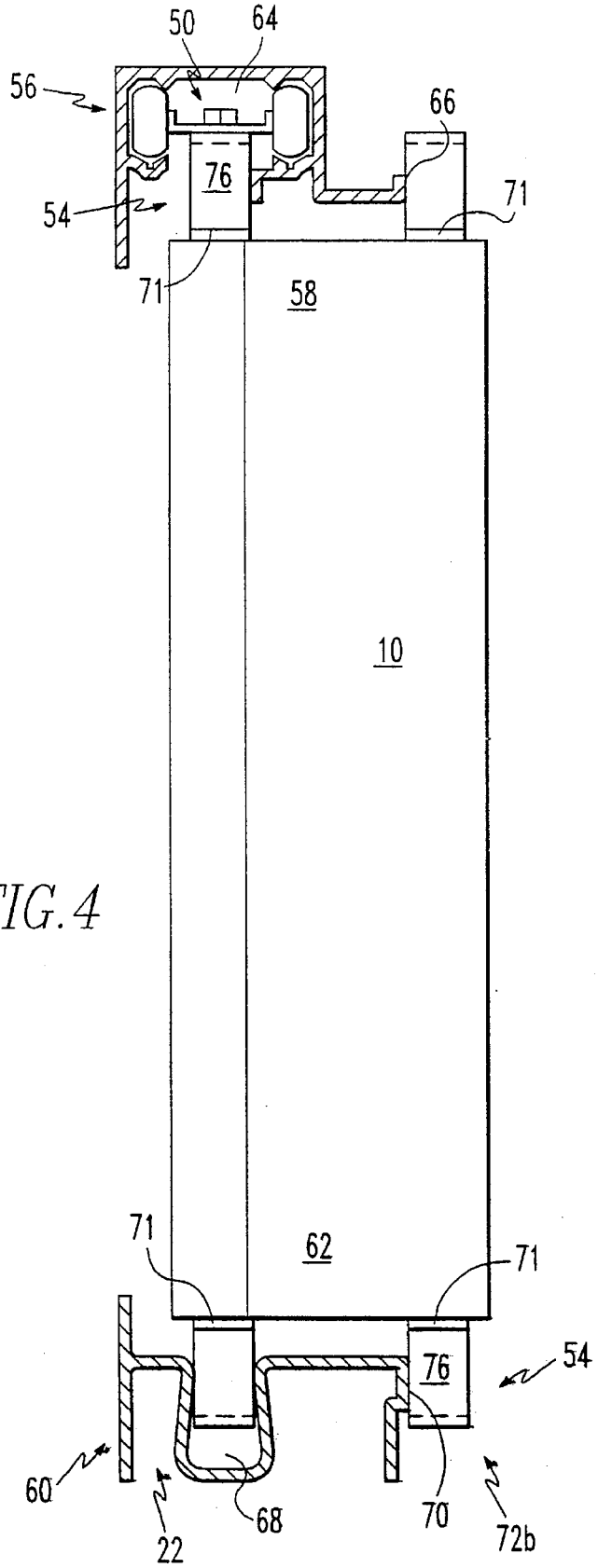
FIG. 4 is a schematic representation of a side view of a shutter blade assembly in a closed state.

The receiving end 14 has a first opening 18 and a second opening 20 adjacent to but separate from the first opening 18. The first opening 18 can be offset from the second opening 20 and the center 19 of the center portion 12. Preferably, the first opening 18 and the second opening 20 are separated by a common wall 21. Preferably, the first opening 18 has a first opening surface 24 and the hooking end 16 has a surface 26. The first opening surface 24 is of opposite shape as the hooking end surface 26 so the hooking end surface 26 fits into and conforms with the first opening surface 24 as shown in FIG. 1*a*. The first opening 18 connects with a hooking end 16 of another shutter blade 100 as shown in FIG. 3. The shutter blade 10 preferably contacts a track mechanism 22 through the second opening 20 as shown in FIG. 4. Preferably, the second opening 20 is of a hemispherical shape. A perspective view of the shutter blade 10 is shown in FIG. 2. It should be noted that shutter blade 100 and shutter blade 10 are of the same shutter blade design. For purposes of discussion and clarification, number 10 is identified with a first shutter blade and number 100 is identified with another shutter blade to which the first shutter blade 10 connects.

Preferably, the side 28 of the common wall 21 which defines part of the first opening surface 24 has a first valley 30 and at least a second valley 32 with a third hill 110 between the first valley 30 and the second valley 32. Preferably, the first opening surface 24 is further defined by a curve stem 38 which extends from the common wall 21 and curves around toward the common wall 21. Preferably, the curve stem 38 has a variable thickness, with the thickness being greatest where the stem 38 extends from the common wall 21.

Preferably, the hooking end surface 26 has a first hill 34 and at least a second hill 36 which fits into the first valley 30 and second valley 32, respectively. Between the first hill 34 and second hill 36 is a third valley 149. The hooking end 16 preferably has a hook portion 40 with the first hill 34 and second hill 36, and a stem opening 42 which receives a stem 38 of a receiving end 14.

Figure 1B:
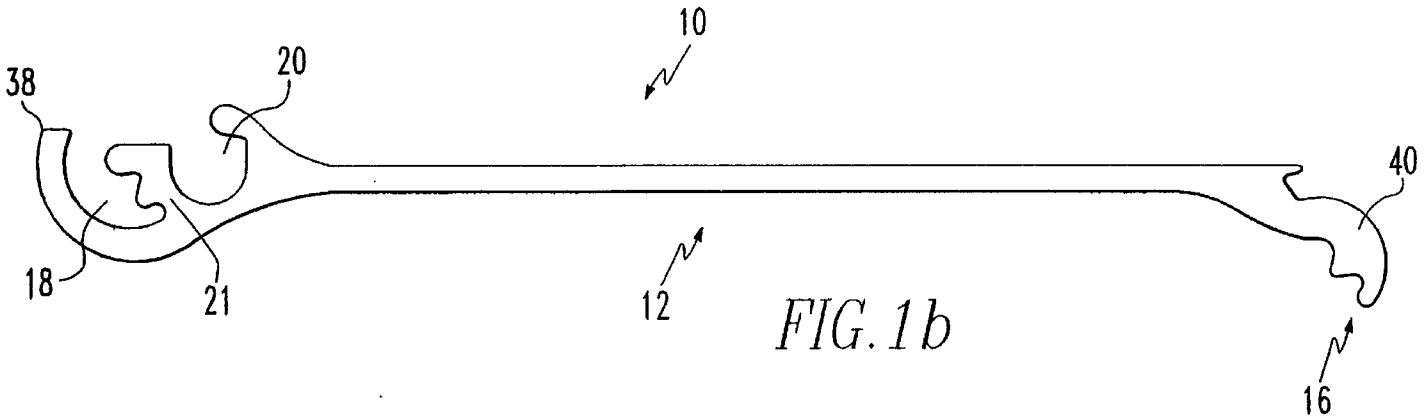
FIG. 1*b* is a schematic representation of an alternative embodiment of the invention.

FIG. 1*b* shows an alternative embodiment of the shutter blade 10. In this embodiment, the receiving end 14 has been modified in terms of its angle relative to the center portion 12, and the length of the stem 38 to further preclude a hooking end 16 from separating from the receiving end 14.

Figure 6:
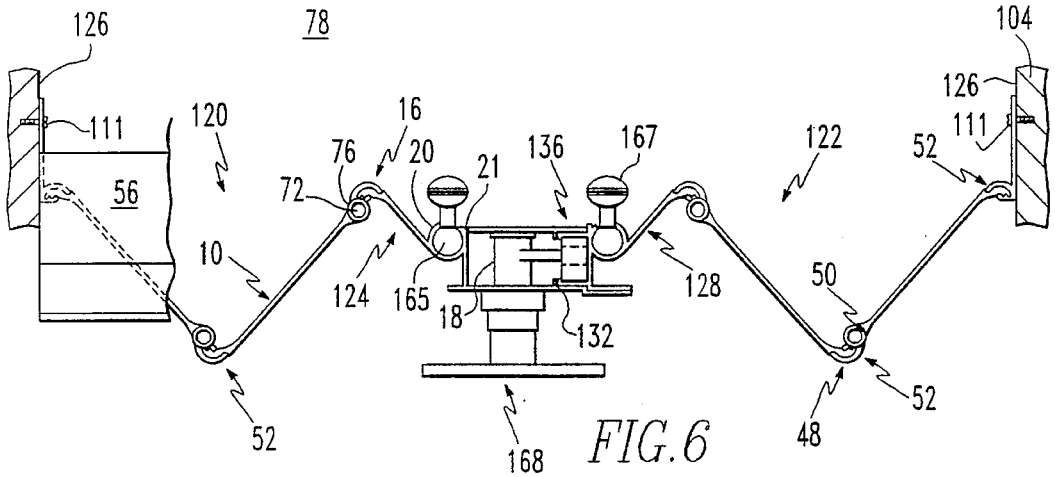
FIG. 6 is a schematic representation of an overhead view of a schematic representation of a shutter blade assembly in a closed state.
Figure 5:
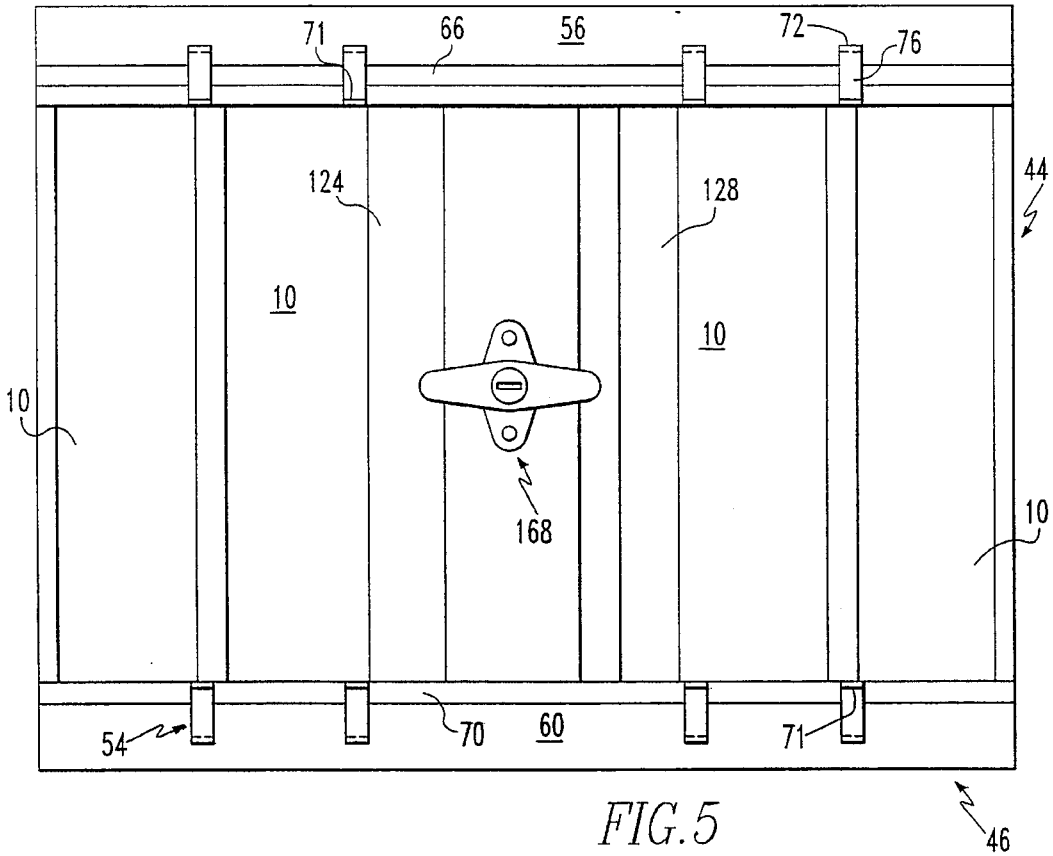
FIG. 5 is a schematic representation of a front view of a shutter blade assembly in a closed state.

The present invention also pertains to a shutter blade assembly 46 as shown in FIGS. 4–9. The shutter blade assembly 46 comprises a track mechanism 22 as shown in FIG. 4. The shutter blade assembly 46 also is comprised of a shutter blade screen 44, as shown in FIG. 5. The shutter blade screen 44 is comprised of a plurality of shutter blades 10 foldably connected in series and movably connected to the track mechanism 22. Each shutter blade 10 is connected to another shutter blade 10 at a first location 48. Each shutter blade 10 contacts the track mechanism 22 through a second location 50 adjacent to but apart from the first location 48, as shown in FIG. 6.

As described above, each shutter blade 10 of the shutter blade assembly 46 preferably has a receiving end 14, with a first opening 18 and a second opening 20 and a hooking end 16. Each shutter blade 10 is connected to another shutter blade 100 at the first location 48 by a respective hooking end 16 mated with a first opening 18 of a respective receiving end 14 which define a hinge 52, as shown in FIG. 3.

The assembly 46 preferably also includes a plurality of linkages 54. Each shutter blade 10 is connected to the track mechanism 22 at the second location 50 through the linkage 54, as shown in FIG. 4. Each linkage 54 is in contact with the second opening 20 of the respective receiving end 14 and the track mechanism 22. Preferably, each linkage 54 comprises a bolt 72 which connects with the second opening 20 of the receiving end 14, as shown in FIG. 4. A bolt 72 is but one means of accomplishing the mechanical task of linking the shutter blade 10 to the track mechanism 22. The industry has employed a "hollow-hollow" shutter blade 10 which is the basis of the preferred embodiment herein. The industry has also used a "hollow-solid" blade where the "solid" is round in shape. In this case, the blades are cut longer than required for the blade function but of the length needed for both blade and pin or bolt functions. The "web" material is then cut away revealing a round which is then threaded and employed as an equivalent bolt. The bolt 72 is used as a locating feature and is preferably encircled with some material such as an extruded plastic sleeve 76 that permits easy movement in the track channel. One could use a pin or equivalent component and either mechanically affix it into the second opening 20 or employ an adhesive and even in addition some mechanical tolerance design to create a push fit. The bolt 72 is preferably a ¼ inch outside diameter self-tap steel screw that is 3 inches long, which is of industrial steel that has a shear stress limit of 45,000 psi. The linkage can also include a washer 71 that is positioned between the sleeve 76 and the second opening 20, as shown in FIGS. 12*a*–12*c* and FIGS. 4 and 5. Alternatively, the washer 71 can be a standard washer. The washer 71 serves to better prevent one blade 10 from sliding down relative to another blade 100.

Preferably, the track mechanism 22 comprises a top track 56 which each shutter blade 10 contacts at each shutter blade's 10 top end 58, and a bottom track 60 which each shutter blade 10 contacts at each shutter blade's 10 bottom end 62, as shown in FIG. 4. Preferably, the top track 56 has a top channel 64 and a top face 66, and the bottom track 60 has a bottom channel 68 and a bottom face 70.

Figure 9:
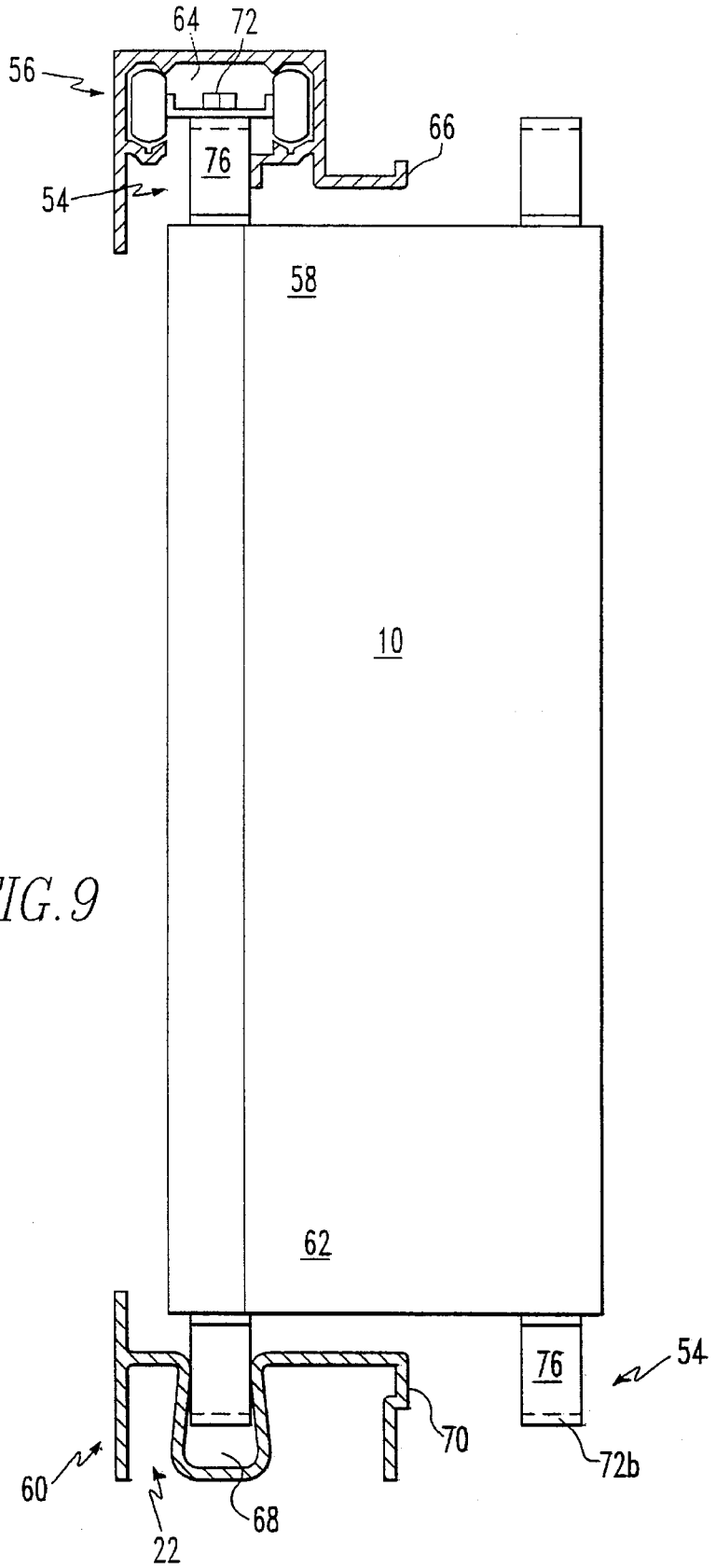
FIG. 9 is a schematic representation of a side view of a shutter blade assembly in a folded state.

Preferably, the plurality of shutter blades 10 connected in series have a closed state as shown in FIGS. 4, 5 and 6 and a folded state as shown in FIGS. 7, 8 and 9. Preferably, when the plurality of shutter blades 10 connected in series are in a closed state, they form a repeating V or zigzag pattern, as shown in FIG. 6, with every even shutter blade receiving end's 14 second opening 20 with a bolt 72 connected into it having the bolt 72 in movable contact with the respective top channel 64 or respective bottom channel 68. Additionally, every odd shutter blade 10 receiving end's 14 second opening 20 with a bolt 72 connected into it has the bolt 72 in movable contact with the respective top face 66 or respective bottom face 70.

When the plurality of shutter blades 10 are in a folded state, the shutter blades 10 fold together in closed accordion fashion, whereby when the plurality of shutter blades 10 connected in series are moved from a closed state to a folded state, the bolts 72 connected in the even shutter blades 10 receiving end 14 move along the respective top or bottom channel 64, 68 and the bolts 72 connected in the odd shutter blades 10 receiving end 14 move away from the respective top face 66 or bottom face 70, as shown in FIG. 4.

Preferably, the linkage 54 includes a sleeve 76 in which the bolt 72 extends. Each sleeve 76 is disposed adjacent the second opening 20 and in alignment therewith as is well known in the art.

The present invention also pertains to a shutter blade 10. The shutter blade 10 comprises a center portion 12 having a receiving end 14 and a hooking end 16. The receiving end 14 has a first opening 18 defined by a first opening surface 24. The first opening 18 connects with a hooking end 16 of another shutter blade 100, as shown in FIGS. 1*a* and 3. The first opening surface 24 is of opposite shape as the hooking end surface 26 so the hooking end surface 26 fits into and conforms with the first opening surface 24 and there is continuous contact therebetween when the hooking end 16 of the other shutter blade 100 and the first opening surface 24 are in a closed state. In this way, the hooking end surface 26 is essentially in smooth continuous contact with the first opening surface 24 and essentially no gaps exist. Preferably, the hinge 52 transfers force through it in a compressive fashion. This is a result of there being continuous contact between the hooking end surface 26 and the first opening surface 24, thus precluding bending from occurring in any gaps; and the shape of hooking end 16 and the first opening surface and stem 38 fitting together to prevent any points thereof from folding up and thus allowing for bending.

The present invention also pertains to a shutter blade assembly 46. The shutter blade assembly 46 comprises a track mechanism 22, as shown in FIG. 4. The shutter blade mechanism also comprises a shutter blade screen 44 comprising a plurality of shutter blades 10 foldably connected in series and movably connected to the track mechanism 22. Each shutter blade 10 is connected to the track mechanism 22 and each shutter blade 10 is of a design that is described in the aforementioned paragraph.

The present invention also pertains to a method for protecting an area 78 from, for instance, flying objects or wind, as shown in FIGS. 4–9. The method comprises the steps of placing a track mechanism 22 about the area 78. Then there is the step of connecting a plurality of shutter blades 10 attached together in series to the track mechanism 22. Next there can be the step of imparting a force to at least one of the shutter blades 10. Then there is the step of diverting force on a hinge 52 connecting at least the one shutter blade 10 through it in a compressive fashion so the one shutter blade 10 does not disconnect from the other shutter blade 100. Then there is the step of transferring the force from the one shutter blade 10 to the track mechanism 22 by a linkage 54 contacting the track mechanism 22 and the one shutter blade 10. The linkage 54 is preferably disposed at a first location 48 separate from the hinge 52.

The present invention also pertains to a method for constructing a shutter blade screen 44. The method comprises the steps of fitting a hooking end 16 of a first shutter blade 10 into a first opening 18 of a receiving end 14 of another or second shutter blade 100. Next there is the step of inserting a first bolt 72 into a second opening 20 of the receiving end 14 preferably disposed at a top end 58 of the second shutter blade 100, although the first bolt 72 could just as well be first inserted into a second opening 20 of the receiving end 14 disposed at the bottom of the second shutter blade 200 (they are equivalent). The second opening 20 is adjacent but separate from the first opening 18.

Preferably, after the inserting step, there is the step of inserting a second bolt 72*b* into the second opening 20 of the receiving end 14 disposed at a bottom end 62 of the second shutter blade 100.

Preferably, after the step of inserting the second bolt 72*b*, there is the step of repeating the fitting, inserting the first bolt 72 and inserting the second bolt 72*b* steps with additional shutter blades 10 until a desired length of shutter blades 10 connected in series is created. Preferably, after the repeating step, there is the step of placing the first bolt 72 and second bolt 72*b* extending from the second opening 20 of the receiving end 14 of each even shutter blade 10 of the shutter blade screen 44 into a track mechanism 22, and placing the first bolt 72 and second bolt 72*b* extending from the second opening 20 of the receiving end 14 of each odd shutter blade 10 of the shutter blade screen 44 in contact with the track mechanism 22.

Figure 10A:
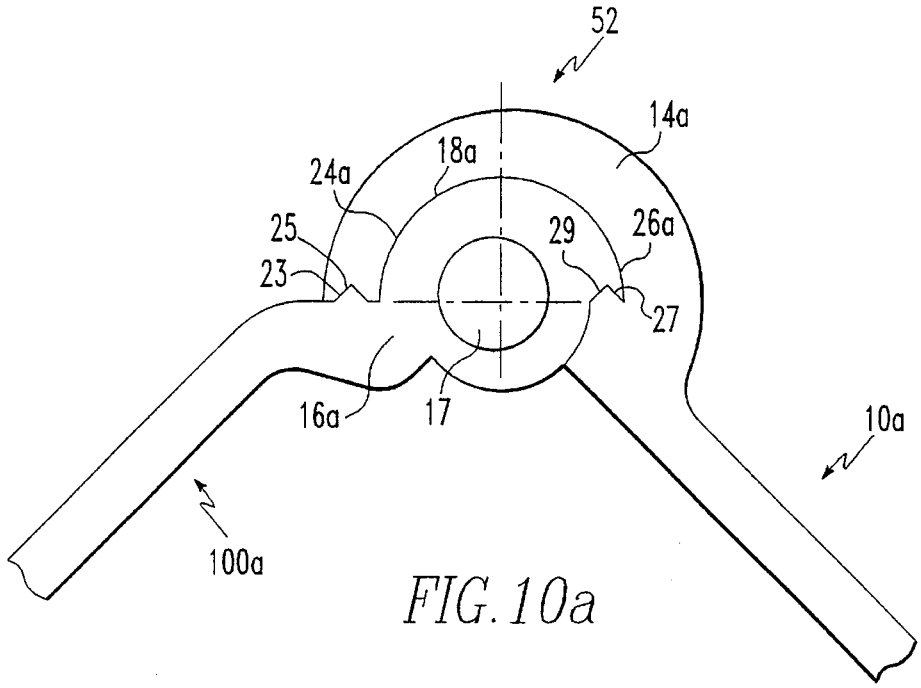
FIGS. 10*a* and 10*b* are schematic representations of an alternative embodiment of a shutter blade of the present invention in a closed state and a folded state, respectively.
Figure 10B:
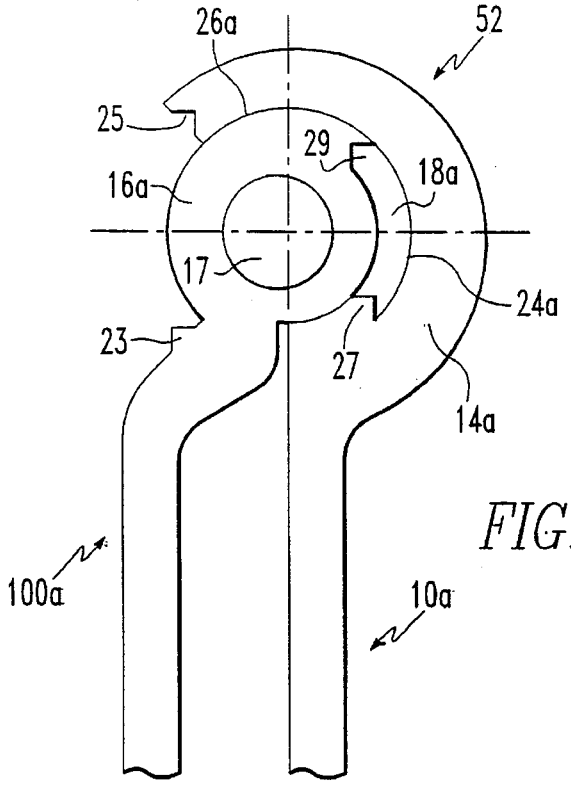

FIG. 10 shows an alternative design of a hinge 52 formed out of a shutter blade 10*a* and another shutter blade 100*a*. In this embodiment, the receiving end 14*a* has a first opening 18*a* defined by a first opening surface 24*a*. However, in the embodiment shown in FIGS. 10*a* and 10*b*, there is no second opening 20. The shutter blade 10*a* has a hooking end 16*a* which fits into and conforms with the first opening 18*a* such that the hooking end surface 26*a* smoothly and continually conforms with and contacts the first opening surface 24*a*. The hooking end 16*a* of the shutter blade 10*a* has a hooking end opening 17 through which a bolt 72 extends instead of, for instance, in a second opening 20 as in the embodiment of the shutter blade 10 described above. The hooking end 16*a* has a first peg 23 which fits into a first slot 25 of the receiving end 14*a*, and the receiving end 14*a* has a second peg 27 which fits into a second slot 29 of the hooking end 16*a* to hold the first opening surface 24*a* and the hooking end surface 26*a* in contact and prevent slippage therebetween.

The present invention also pertains to a shutter blade 10, as shown in FIG. 1*a*. The shutter blade 10 comprises a center portion 12 having a receiving end 14 and a hooking end 16. The receiving end 14 has a first opening 18 and a second opening 20. The first opening 18 connects with a hooking end 16 of another shutter blade 100. The shutter blade 10 contacts a track mechanism 22 through the second opening 20. The receiving end 14 has a curved stem 38 which extends from a wall, such as common wall 21, that together with the curved stem 38 defines the first opening 18. The curved stem 38 has a variable thickness, with the thickness being greatest where the stem 38 extends from the wall. The curved stem 38 having a variable thickness provides resistance to cantilever bending (force created by a lever) with a minimal amount of material. The variable thickness stem 38 does not preclude a bending moment from being created (the cantilever does create a bending moment) but it does provide higher resistance to this bending which then avoids the deflection of the stem 38 and subsequent separation possibility when a load within the rated range is experienced by the stem 38. As one example of many possible examples of the variable thickness of the stem 38 in FIG. 1*a*, the thickest part of the stem 38 where it extends from common wall 21 is 1.357 times as thick as the thickness of the stem 38 at its free end. Similarly, in regard to FIG. 1*b*, it is 1.268 times as thick as the thickness of the stem 38 at its free end.

Figure 11:
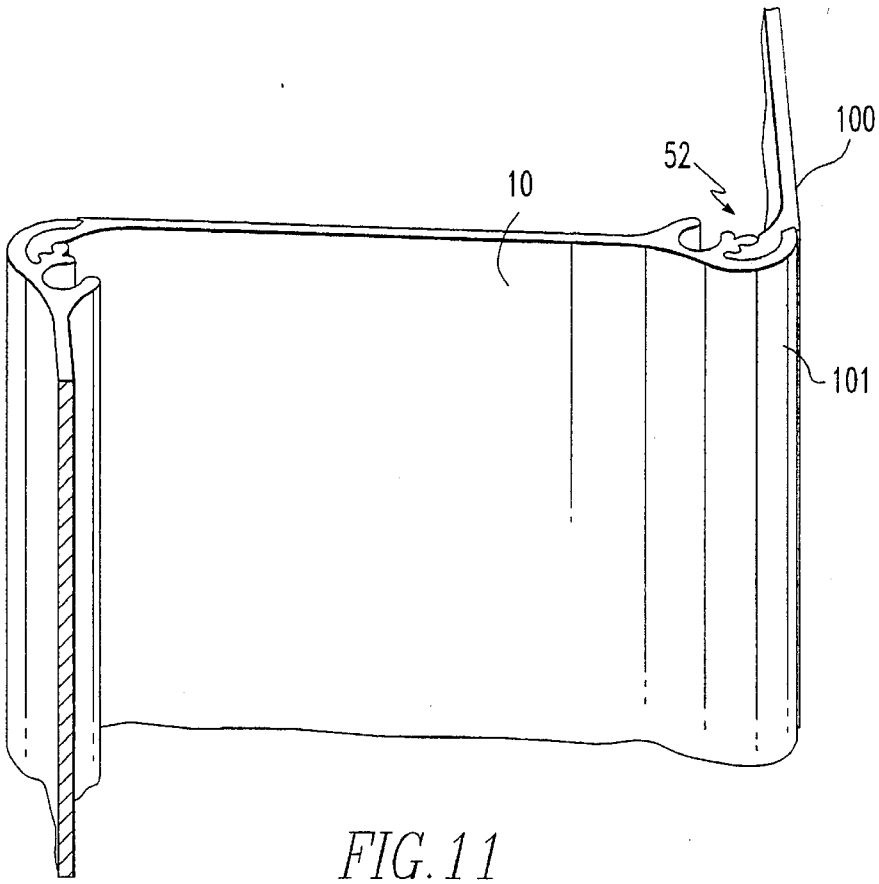
FIG. 11 is a schematic representation of a perspective view of two shutter blades connected in series forming a rib.
Figure 12B:
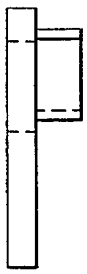
FIGS. 12*a*, 12*b* and 12*c* are overhead, side and cross-sectional schematic views, respectively, of a washer.
Figure 12A:
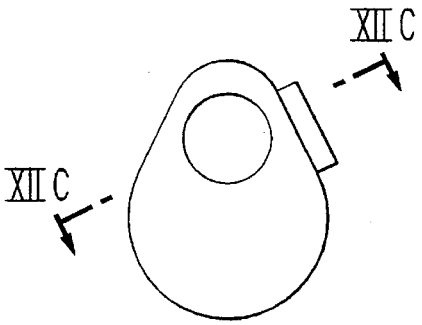
Figure 12C:
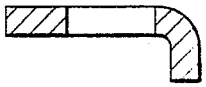

The present invention pertains to a shutter blade 10. The shutter blade 10 comprises a center portion 12 having a receiving end 14 and a hooking end 16. The receiving end 14 has a first opening 18 and a second opening 20. The first opening 18 connects with a hooking end 16 of another shutter blade 100 to form an essentially solid hinge 52 that defines a rib 101, as shown in FIG. 11. The shutter blade 10 contacts a track mechanism 22 through the second opening 20. The solid hinge 52 that defines the rib 101 extends the length of the shutter blade 10 which provides greater strength for a given size and weight than a hinge that would have openings or voids in it. The presence of these openings or voids would be areas of weakness that could cause failure of the hinge 52 for a given force experienced by the hinge 52.

The present invention pertains to a shutter blade 10. The shutter blade 10 comprises a center portion 12 having a receiving end 14 and a hooking end 16. The receiving end 14 has a first opening 18 defined by a first opening surface 24. The first opening 18 connects with a hooking end 16 of another shutter blade 100 to form a hinge 52. The first opening surface 24 is of opposite shape as the hooking end surface 26 so the hooking end surface 26 fits into and conforms with the first opening surface 24 and there is continuous contact therebetween when the hooking end 16 of the other shutter blade 100 and the first opening surface 24 are in a closed state. The hooking end surface 26 and the first opening surface 24 together form locking features which maintain the hooking end 16 and the first opening 18, as shown in FIG. 3. Preferably, these locking features are defined by the stem 38 in accord with stem opening 42; first valley 30 and second valley 32 in accord with first hill 34 and second hill 36, respectively; and third hill 110 and third valley 149, respectively. These locking features maintain the integrity of the hinge 52 when it experiences a force within its rated range. The locking features serve to prevent slippage of the hooking end 16 relative to the receiving end 14 as well as separation thereof when the hinge 52 experiences forces within its rated range.

The present invention also pertains to a shutter blade assembly 46, as shown in FIGS. 4–9. The shutter blade assembly 46 comprises a track mechanism 22. The shutter blade assembly 46 also comprises a shutter blade screen 44 comprised of a plurality of shutter blades 10 foldably connected in series and movably connected to the track mechanism 22. The screen 44 has a folded state, as shown in FIG. 7, and a closed state, as shown in FIG. 5. The screen 44 has a stacking ratio of up to approximately 13% and is in compliance with South Florida Building Codes Section 2309, 2314.5 and 2315 with revisions to include ASCE 7-88 criteria and large missile impact requirements, and Dade County Protocols PA 201-94, 202-94 and 203-94. Stacking ratio is defined to be the length of screen 44 when it is in a folded state divided by the length of the screen 44 in a closed state multiplied by 100% but not including the mating blade.

The present invention pertains to a shutter blade assembly 46. The shutter blade assembly 46 comprises a track mechanism 22. Additionally, the shutter blade assembly 46 comprises a shutter blade screen 44 comprised of a plurality of shutter blades 10 foldably connected in series and movably connected to the track mechanism 22. The screen 44 is in compliance with South Florida Building Codes Section 2309, 2314.5 and 2315 with revisions to include ASCE 7-88 criteria and large missile impact requirements, and Dade County Protocols PA 201-94, 202-94 and 203-94.

In the operation of the invention, a shutter blade screen 44 of a shutter blade assembly 46, as shown in FIG. 5, is formed by first taking a hooking end 16 and sliding it into a receiving end 14 of another shutter blade 100, as shown in FIGS. 1*a*, 2 and 3. The hook portion 40 of the hooking end 16 has a hook end surface 26 with a first hill 34 and a second hill 36, a third valley 149 therebetween and cylindrical surface 160 which conforms with the pivoting bulb 161 of the receiving end 14. The first valley 30 and second valley 32 receive the first hill 34 and second hill 36, respectively; the third hill 110 between the first valley 30 and second valley 32, fits into the third valley 149, between the first hill 34 and second hill 36; and the curve stem 38 of the receiving end 14 fits into the stem opening 42 of the hooking end 16. The placement of the hills 34, 36, 110 in the respective valleys 30, 32, 149 and the stem 38 in the stem opening 42 serves to lock the hooking end 16 into the receiving end 14 and essentially preclude any slippage therebetween. This also serves to prevent the hooking end 16 and the receiving end 14 from coming apart upon experiencing forces within their operable range.

The combination of the hooking end 16 positioned in the receiving end 14 forms a hinge 52 between the shutter blade 10 and the other shutter blade 100. The hinge 52 is solid in the closed state and forms a rib 101. This rib 101 by being solid and running the length of the blade 10 serves to strengthen the overall structure since there are no voids whose presence could result in the hinge deforming under a load, which is now higher than it otherwise could be.

Over the second opening 20 is placed a sleeve 76. A bolt 72 is inserted through the sleeve 76 and into the second opening 20. The bolt 72 is threaded into the second opening 20 to be securely fixed to it. The insertion of the bolt 72 into the second opening 20 through the sleeve 76 occurs for both the top end 58 and the bottom end 62 of the shutter blade 10.

The above described process is then repeated to connect additional shutter blades 10 onto the shutter blade 10 and other shutter blade 100 that have already been connected. In this way, a shutter blade screen 44 comprised of a plurality of shutter blades 10 connected in series for a desired length is formed.

The shutter blades 10 connected in series form an alternating V pattern when the shutter blade screen 44 is in a closed state, as shown in FIG. 6. This is because the hooking end 16 of the shutter blade 10 fits into the receiving end 14 of another shutter blade 100 in an angular relationship, such as 90°, which complements itself when the hooking end 16 of shutter blade 100 is connected to the receiving end 14 of yet another shutter blade 10. Since this alternating V pattern is formed, when the shutter blade screen 44 is combined with the track mechanism 22, only the bolt 72 extending from the second opening 20 of the even shutter blade 10 is inserted into the top track 56, in regard to the top end 58 of the shutter blade 10, and the bottom track 60, in regard to the bottom end 62 of the shutter blade 10. As the bolt 72 of the top end 58 and bottom end 62 of the even shutter blades 10 of the shutter blade screen 44 are fed into the top channel 64 and bottom channel 68, respectively, the bolts 72 extending from the second opening 20 of the odd shutter blades 10 move along the top face 66 and bottom face 70, respectively, of the track mechanism 22. As the bolts 72 are fed into the top track 56 or bottom track 60, the sleeve 76 about the bolt 72 are also feed into the respective channels, as is well known in the art concerning shutter blade assemblies and tracks. Similarly, the sleeve 76 about the bolt 72 of the odd shutter blades 10 of the shutter blade screen 44 rest against the top face 66 or bottom face 70.

When the shutter blade screen 44 is desired to be placed in a folded state, as shown in FIG. 7, the shutter blades 10 move to the side of the area 78 which is to be protected by the shutter blade assembly 46. As each shutter blade 10 moves to the side of the area 78, each of the bolts 72 in the top channel 64 or bottom channel 68 rotate as they also translate along the respective channel to allow the shutter blades 10 to fold upon each other into the folded state. Moreover, during this movement of the shutter blades 44 into a folded state, each stem 38 of each receiving end 14 and each corresponding hook portion 40 rotate relative to each other such that the curve stem 38 moves out of and away from the stem opening 42 of the hooking end 16, and the first hill 34 and second hill 36 of each hooking end 16 rotate away from the respective first valley 30 and second valley 32 until the inner surface 96 of the hooking end 16 contacts the second wall 98 of the receiving end 14, at which point the shutter blade 10 and other shutter blade 100 can no longer rotate relative to each other.

As the screen 44 is folded, the bolt 72 of each odd shutter blade 10 of the shutter blade screen 44 moves outward and away from the top face 66 and bottom face 70 since there is no constraint about either top face 66 or bottom face 70. This movement of the bolt 72 of the odd shutter blades 10 of the shutter blade screen 44 during its folding allows the shutter blade screen 44 to compactly fold by allowing the respective hinges 52 associated with the odd shutter blades 10 and the respective bolts 72 associated with the odd shutter blades 10 of the screen to move outward away from either the top face 66 or bottom face 70.

When the shutter blade screen 44 goes from a folded state to a closed state, the opposite action of the aforementioned action occurs. The curve stem 38 rotates into the stem opening 42 until it is seated therein, at which point it can no longer rotate further closed; and at the same time and in coordination therewith, the first hill 34 and second hill 36 of the hooking end 16 enters into first valley 30 and second valley 32, respectively, of the receiving end 14, and third hill 110 enter the third valley 149, thus precluding further rotation or slippage of the shutter blade 10 with the other shutter blade 100. The shutter blade screen 44 is then in the closed state. When the shutter blade screen 44 is moved from a folded state to a closed state, the hinges 54 and bolt 72 associated with the odd shutter blades 10 move toward the respective top face 66 or bottom face 70 until the shutter blade screen 44 is essentially in a closed position. At this point, the bolt 72 of the odd shutter blades 10 of the screen 44 have contacted the top face 66 or bottom face 70 and are constrained from moving further, as is the hinge 52 which has closed essentially as far as it can go since the curve stem 38 has seated against the stem opening 42 and the first hill 34, second hill 36, and third hill 110 have moved into the first valley 30, second valley 32, and third valley 149.

The shutter blade screen 44 is preferably comprised of a first screen side 120 and a second screen side 122. The shutter blade screen 44 can be put into the folded state by separating the shutter blade screen 44 so the first screen side 120 goes into the folded state at one side of the area 78 and the second screen side 122 goes into the folded state at the opposing side of the area 78. In this embodiment, the first screen side 120 has a first mating blade 124 which is at the opposite end of the first screen side 120 from its starter blade 126 that connects the first screen side 120 to the frame 104, as shown in FIG. 8. Similarly, the second screen side 122 has a second mating blade 128 which is at the opposite end of the second screen side 122 from its starter blade 126. The first mating blade 124 connects with the second mating blade 128 to allow closure of the shutter blade screen 44 in the folded state.

The first mating blade 124 has a hooking end 16, as described above, and a receiving end 14 comprised of a second opening 20 and a first opening 18. In this embodiment, the first opening 18 is preferably rectangular shaped. There is a common wall 21 between the first opening 20 and second opening 18. Second mating blade 128 has these same elements except that the first opening 18 of second mating blade 128 has a rectangular shape which fits into the first opening 18 of the first mating blade 124. The first mating blade 124 has stops 132 which extend into the first opening 18 from the first openings defining walls 134. These stops abut the first opening 18 of the second mating blade 128 when the first opening 18 of the second mating blade 120 is inserted into the first opening 18 of the first mating blade 124.

The second openings 20 of both the first mating blade 124 and second mating blade 128 can be used to receive rods 165, otherwise known as deadbolts, that extend either downwards or upwards or both to contact a part of the frame 104. The part of the frame 104 can be, for instance, a sill of a window, etc. In the rods 165 are placed threaded screws and there can be a wing nut 167 connected to the threaded screws. When the shutter blade screen 44 is in the closed state and the first mating blade 124 is connected with the second mating blade 128, the wing nut 167 can be rotated to allow the rod 165 to move downwards, or upwards, or both, to contact the frame 104. The frame 104 can have a hole in which the rod 165 enters, or the rod 165 can contact the top of the frame 104 surface and by way of friction created by the wing nut being rotated enough to force the rod 165 against the frame 104, hold the respective first mating blade 124 or second mating blade 128 into position after the other rod 165 associated with the other mating blade is also turned so that the closed state will not be lost. The operation of the rod 165 or deadbolt and wing nut is well known to one skilled in the art.

Alternatively, either with the rod 165 in the respective second openings 20 of the first mating blade 124 and second mating blade 128, or with the lack thereof in the second openings 20, a locking mechanism 168 can be inserted at a desired location in the housing 136 that is defined by the first opening 18 of the first mating blade 124 and the first opening 18 of the second mating blade 128 being in mating relationship. The locking mechanism 128 is connected to both the first opening 16 of the first mating blade 124 and the first opening 18 of the second mating blade 128 and holds them together when in a locked position as is well known in the art.

During use of the shutter blade assembly 46, the shutter blade screen 44 is placed in a closed state so the area 78 is protected by it. This area 78 can be a door or a window, etc. When, for instance, a flying object caused by a high wind moving it through the air, strikes a shutter blade 10, the force imparted by the object onto the shutter blade 10 causes the bolts 72 that contact the top channel 64 and bottom channel 68 and top face 66 and bottom face 70 to transmit the force to the track mechanism therethrough by the bolts being pushed against the top channel 64, bottom channel 68 or top face 66 or bottom face 70. At the same time, the hinge 52 is designed such that the force imparted by the flying object 86 is transmitted through it essentially in a compressive fashion so the hinge 52 is not broken and the shutter blade 10 does not separate from the other shutter blade 100 to which it is connected. The hinge 52 is designed to transfer force through it in a compressive fashion regardless of where the force is imparted to the shutter blade 10. This is accommodated by the fact that the force imparted to the blade 10 is transferred through the bolt 72 to the track mechanism 22 at the second location 50 while the hinge that maintains the shutter blade 10 and shutter blade 100 together is disposed at a first location 48. Thus, the hinge 52 does not also have to be designed to transmit the force imparted to the shutter blade 10 to the track mechanism 22. It only has to be designed to maintain the hinge's integrity under such forces and transmit force through the hinge 52 to the bolt 72. Similarly, the bolt 72 only has to be concerned with transmitting the force from the shutter blade 10 to the track mechanism 22 and not be concerned with maintaining the integrity of the hinge 52.

The functionality of the bolt 72 is readily apparent in terms of how it transmits the force imparted on a shutter blade 10. The force essentially moves the bolts 72 of the odd shutter blades 10 of the shutter blade screen 44 against the top face 66 or bottom face 70 and moves the bolts 72 in the top end 58 or bottom end 62 of the even shutter blades 10 against the side of the top channel 64 or bottom channel 68 causing the bolts 72 to push thereagainst and transmit the force thereto.

In regard to the action of the hinge 52 essentially going into a compression phase with minimal bending experienced when a force is imparted to a shutter blade 10, several examples will now be provided. Referring to FIG. 3, if an object strikes a shutter blade 100 as depicted by arrow 106, the force causes the shutter blade 100 to move essentially in the direction of the force since the hooking end 16 of the shutter blade 10 is supported and connected at hinge 52 to shutter blade 10 and receiving end 14 of another shutter blade 100 is also connected to a hooking end 16 of a shutter blade 10. The fact that the shutter blade 100 is supported at both of its ends essentially precludes the shutter blade 100 from rotating relative to the shutter blade 10. Furthermore, focusing on the hooking end 16 of shutter blade 100 which has, for instance, been struck by an object at 106, the hooking end surface 26 pushes against curve stem 38, which in turn pushes against stem opening wall 108 which holds stem 38 in place. Also, second hill 36 pushes against stem 38. The hills 34, 36, 110 in the valleys 30, 32, 149 of the blade prevent sliding and relative movement of the blades 10 and 100 under the force and maintain the hooking end surface 26 and the first opening surface 24 in constant contact. In this way, the hooking end surface 26 is maintained in contact with the first opening surface 24 and essentially no bending occurs in the hinge 52, only a compression phase. By the stem 38 being thickest at the location where it extends from the common wall 21, it is better able to withstand forces created by the lever action of the force 106 times the distance to the second hill 36 pressing against it and possibly bending the stem 38 off at the common wall 21. The main reason for stem 38 being thickest at common wall 21 is to prevent bending stem 38 during loading. The hills and valleys help prevent the hinge from separating during impact. The purpose of the first valley 30, second valley 32 and third valley 149 is to provide a greater surface area to the interface of the receiving end 14 and the hooking end 16 than would otherwise be present if the first valley 30, second valley 32 and third valley 149 were not present. The greater the surface area of the interface of the hooking end 16 and the receiving end 14, in general, the more surface area can be provided to spread out a given force to lessen its concentration and the more sturdy the hinge 52 will be to withstand forces. They also serve to prevent sliding and movement of the hooking end 16 relative to the receiving end 14 under the load to create as good a contact as possible between their surfaces as well as to provide a greater surface of contact. Constant contact of these two surfaces as well as increased contact area provide hinge 52 the ability to withstand outside forces from any direction.

In an example where an object imparts a force 112 to the shutter blade 100, the stem opening wall 108 pushes against the curve stem 38. Cylindrical surface 160 pushes against pivoting bulb 161 and additionally, the first hill 34, second hill 36 and third valley 149 push against the first valley 30, second valley 32 and third hill 110 to minimize bending and thus prevent separation of the first opening surface 24 from the hooking end 16 with a breakdown in the integrity of the hinge 52.

When a force 114 is applied to the hinge 52 from a flying object, the curve stem 38 is pushed down against the stem opening 42 and the hook portion 40 of the hooking end 16 of the shutter blade 100. The hooking end 16, first hill 34, second hill 36 and third valley 110 in turn push against first valley 30, second valley 32 and third hill 149, respectively, to prevent bending movement and maintain the hooking end 16 in a compressive phase so it cannot separate in some fashion from the first opening 18 and effect the integrity of the hinge 52 while it transmits force therethrough.

If an object imparts a force 116 on the shutter blade 10, the stem 38 pushes against the stem opening wall 108, maintaining the stem 38 in the stem opening 42. The stem 38 also pushes against the hooking end 16, and the first valley 30, second valley 32 and third hill 149 push against the first hill 34, second hill 36 and third valley 110, respectively. This action places the hooking end 60 in a compressive phase from the receiving end 14 of the shutter blade 10 pushing against it to transfer force therethrough, and precludes material bending action which could cause an opening between the hooking end surface 26 and the first opening surface 24 to effect the integrity of the hinge 52.

If an object strikes the shutter blade 100 and imparts a force 118 to it, the hooking portion 40 pushes against the curve stem 38*a*. Curve stem 38 pushes against the stem opening wall 108 precluding the stem 38 from moving out of the stem opening 42. It places a strain on the curve stem 38 which is greatest at the point where the stem 38 extends from the common wall 21. However, because the stem 38 is thickest at this point, the stem 38 is strong enough to receive such a strain, transfer force through it to the bolt 72, and preclude a material bending moment being created, thus separating the hook end surface 26 from the first opening surface 24 and effecting the integrity of the hinge 52.

As explained above, various forces applied to the shutter blades 10 will be transmitted by the bolt 72 to the frame 104 or converted into forces of a compressive nature by the design of the hinge 52 so the integrity of the hinge is not effected. Alternative forces can occur but they will essentially be the sine or the cosine of the forces described above.

The shutter blade assembly 46 can be placed in front of an area 78 in a number of ways. There can be screws 111 penetrating through the starter blade 126 to fix the starter blade 126 to the frame 104. By having the screws 111 penetrating the starter blade 126 all along its side, the shutter blade screen 44 is fixed on one side to the frame 104. This would also occur on the opposing side of the area to mount the other side of the shutter blade screen 44 thereto, as shown in FIG. 6. The starter blade 126 could, for instance, fit around a masonry wall, wood wall or various other materials and masonry screws or the appropriate type of screws or bolts can be inserted to the shutter blade 126 to mount the shutter blade 126 to the masonry wall, thus mounting the shutter blade screen 44 thereto. Alternatively, different angles of the shutter blade 126 can be used. For instance, if the hinge 52 and the center portion 12 are essentially at a 0 angle, the starter blade 126 can be mounted directly to a frame 104. The track mechanism 22 is also fixed with screws or bolts or the like into place about the area 78 to receive and hold the shutter blade screen 44.

The material is 6063-T6 aluminum and the shutter blade 10 has an estimated weight per foot of 0.512 lbs. It has a length of 64 inches and a width of about 4.2 inches from tip to tip. Obviously, these dimensions will vary depending on the size of the area 78 being protected.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A shutter blade assembly comprising:

a track mechanism; and a shutter blade screen comprising a plurality of shutter blades foldably connected in series and movably connected to the track mechanism, each shutter blade comprising a center portion having a receiving end and a hooking end, said receiving end having a first opening and a second opening adjacent to but separate from said first opening, said first opening connecting with a hooking end of another shutter blade, said shutter blade contacting the track mechanism through said second opening, said second opening being of hemispherical shape, said first opening is defined by a first opening surface and the hooking end has a surface, and a common wall between the first opening and the second opening, the side of the common wall which defines part of the first opening surface has a first valley and at least a second valley and a third wall therebetween, said first opening surface being of opposite shape as the hooking end surface so the hooking end surface fits into and conforms with the first opening surface and there are essentially no gaps therebetween when the hooking end of another shutter blade and the first opening surface are in a folded state.

2. A shutter blade assembly as described in claim 1 wherein the hooking end surface has a first hill and at least a second hill and a third valley therebetween which fits with the first valley, second valley and third hill, respectively.

3. A shutter blade assembly as described in claim 2 wherein the first opening and second opening are separated by a common wall.

4. A shutter blade assembly as described in claim 3 wherein the first opening surface is further defined by a curved stem which extends from the common wall and curves around toward the common wall.

5. A shutter blade assembly as described in claim 4 wherein the curved stem has a variable thickness, with the thickness being greatest where the stem extends from the common wall.

6. A shutter blade assembly as described in claim 5 wherein the hooking end has a hook portion with the first and second valleys and a stem opening which receives a stem of a receiving end.

7. A shutter blade assembly as described in claim 6 wherein the center portion is elongate and essentially straight and flat.

8. A shutter blade assembly as described in claim 7 wherein the first opening is offset from said second opening and the center of the center portion.

9. A shutter blade assembly comprising:

a track mechanism;

a shutter blade screen comprising a plurality of shutter blades foldably connected in series and movably connected to the track mechanism, each shutter blade connected to another shutter blade at a first location, each shutter blade contacts the track mechanism through a second location adjacent to but apart from the first location;

each shutter blade has a receiving end, with a first opening and a second opening, and a hooking end, each shutter blade connected to another shutter blade at the first location by a respective hooking end fitted with a first opening of the respective receiving end which define a hinge, said track mechanism comprises a top track which each shutter blade contacts at each shutter blade's top end, and a bottom track which each shutter blade contacts at each shutter blade's bottom end, said top track has a top channel and a top face, and the bottom track has a bottom channel and a bottom face; and a plurality of linkages, each shutter blade connected to the track mechanism at the second location through one of the plurality of linkages, each linkage in contact with the second opening of the respective receiving end and the track mechanism, each linkage comprises a bolt which connects with the second opening of the receiving end, said plurality of shutter blades connected in series having a folded state and a closed state such that when the plurality of shutter blades connected in series are in a closed state, they form a repeating V pattern, with every even shutter blade receiving end's second opening with a bolt connected into it having the bolt head in movable contact with the respective top channel or respective bottom channel, and with every odd shutter blade receiving end's second opening with a bolt connected in it in movable contact with the respective top face or respective bottom face, and when they are in a folded state, the shutter blades fold together in dosed accordion fashion, whereby when the plurality of shutter blades connected in series are moved from a folded state to a closed state, the bolts connected in the even shutter blade's receiving end's second opening move along the respective top or bottom channel, and the bolt connected in the odd shutter blade receiving end's second opening move away from the respective top face or bottom face.

10. An assembly as described in claim 9 wherein the linkage includes a sleeve in which the bolt extends, said sleeve disposed adjacent the second opening and in alignment therewith.

11. An assembly as described in claim 10 wherein the first opening is defined by a first opening surface of the receiving end, said first opening surface being of opposite shape as the hooking end surface so the hooking end surface fits into and conforms with the first opening surface and there is continuous contact therebetween when the hooking end of another shutter blade and the first opening surface are in a folded state.

12. An assembly as described in claim 11 wherein the hinge transfers force through it in a compressive fashion.

* * * * *